United States Patent [19]

Vernam et al.

[11] Patent Number: 4,711,762

[45] Date of Patent: Dec. 8, 1987

[54] ALUMINUM BASE ALLOYS OF THE A1-CU-MG-ZN TYPE

[75] Inventors: William D. Vernam; Bernard W. Lifka, both of New Kensington, Pa.

[73] Assignee: Aluminum Company of America, Pittsburgh, Pa.

[21] Appl. No.: 421,341

[22] Filed: Sep. 22, 1982

[51] Int. Cl.[4] ..... C22C 21/10

[52] U.S. Cl. ..... 420/532; 148/11.5 A; 148/12.7 A; 148/415; 148/417; 148/439; 148/440; 420/541

[58] Field of Search ..... 420/532, 541; 148/11.5 A, 12.7 A, 439, 440, 415, 417, 418

[56] References Cited

U.S. PATENT DOCUMENTS 4,126,448 11/1978 Moore et al. ..... 148/11.5 A 4,412,870 11/1983 Vernam et al. ..... 148/11.5 A

*Primary Examiner*—R. Dean

*Attorney, Agent, or Firm*—Andrew Alexander

[57] ABSTRACT

An improved aluminum base alloy product is disclosed, the product comprising 0 to 3.0 wt. % Cu, 0 to 1.5 wt. % Mn, 0.1 to 4.0 wt. % Mg, 0.8 to 8.5 wt. % Zn, at least 0.005 wt. % Sr, max. 1.0 wt. % Si, max. 0.8 wt. % Fe and max. 0.45 wt. % Cr, 0 to 0.2 wt. % Zr, the remainder aluminum and incidental elements and impurities.

26 Claims, 6 Drawing Figures

ALUMINUM BASE ALLOYS OF THE A1-CU-MG-ZN TYPE

INTRODUCTION

This invention refers to aluminum base alloys and more particularly it refers to aluminum base alloys of the Al-Cu-Mg-Zn type.

Aluminum alloy of the Al-Cu-Mg-Zn type can be used for structural components in aircraft because of their high strength-to-weight ratio. 7050 and 7075 are typically of the type of alloy. The 7050 alloy finds wide application in the aircraft industry because of its high tensile strength, e.g. and yield strength, e.g. good fracture toughness and high resistance to exfoliation corrosion and to stress corrosion cracking. However, even though 7050 has been used successfully in these applications, it has not been without problems. For example, in order to optimize the properties of 7050, it has required unusually long soak times at temperatures over 800° F. in order to dissolve certain constituents, such as Al-Cu-Mg.

It will be appreciated that this phase or constituent is important since it impinges directly on tensile properties and toughness. However, as will be obvious, long soak times can be detriment, especially from the standpoint of optimizing properties such as toughness, etc. which are very important particularly in aircraft application. Of course, it will be understood that long soak times are only beneficial with respect to soluble constituents. However, with respect to insoluble constituents such as iron bearing phases, the soak is of no particular benefit. Thus, the particle size of insoluble materials are controlled in one sense normally by the casting and solidification rate thereof and to some extent by composition limits. Accordingly, if coarse insoluble constituents are encountered in casting, then properties such as toughness suffer and optimization of the properties with respect to this feature is virtually impossible.

It will be appreciated that the particle size of intermetallics both soluble and insoluble are related to cell size of these aluminum base alloys. That is, when the cells are larger, the intermetallic particles or constituents are normally larger and conversely when the cells are smaller the intermetallic particle size are normally smaller. Heretofore, it is believed that the only known way to influence cell size in Al-Cu-Zn-Mg alloys has been to control the solidification rate of ingot. However, as the ingot gets greater in size, it becomes increasingly more difficult to control the solidification rate, and as a consequence, with greater ingot size, properties tend to deteriorate. Because of the benefits which can be obtained, there has been ever increasing emphasis on solving these problems.

The present invention solves the problems encountered in alloys of the Al-Cu-Zn-Mg type and provides a product of this type which does not require the long soak time to put soluble intermetallic particles into solid solution. Further, the present invention provides a product having refined insoluble intermetallic constituents. The refined constituents can be achieved in aluminum alloy products without adverse effects on properties. It will be appreciated that obtaining these qualities with improved properties result in a remarkably unique aluminum base alloy product.

OBJECTS

A principal object of this invention is to provide a wrought aluminum base alloy product.

Another object of this invention is to provide a wrought aluminum base alloy product of the Al-Mg-Zn type.

Yet another object of this invention is to provide an aluminum base alloy of the Al-Cu-Mg-Zn type having refined intermetallic phases.

And yet another object of this invention is to provide an aluminum base alloy of the Al-Cu-Mg-Zn type characterized by having refined cell size.

A further object of the present invention is to provide a wrought aluminum base alloy product having improved toughness.

Yet a further object of the present invention is to provide an aluminum base alloy product of the Al-Cu-Mg-Zn type characterized by shorter soak times to put soluble constituents into solid solution.

These and other objects will become apparent from the specification, figures and claims appended hereto.

SUMMARY OF THE INVENTION

In accordance with these objects, an improved aluminum base alloy product is provided. The alloy comprises 0 to 3.0 wt.% Cu, 0 to 1.5 wt.% Mn, 0.1 to 4.0 wt.% Mg, 0.8 to 8.5 wt.% Zn, at least 0.005 wt.% of an element selected from the group consisting of Sr, Sb and Ca, max. 1.0 wt.% Si, max. 0.8 wt.% Fe and max. 0.45 wt.% Cr, 0 to 0.2 wt.% Zr, the remainder aluminum and incidental elements and impurities.

DETAILED DESCRIPTION OF THE PREFERRED EMBODIMENTS

Figure 1:
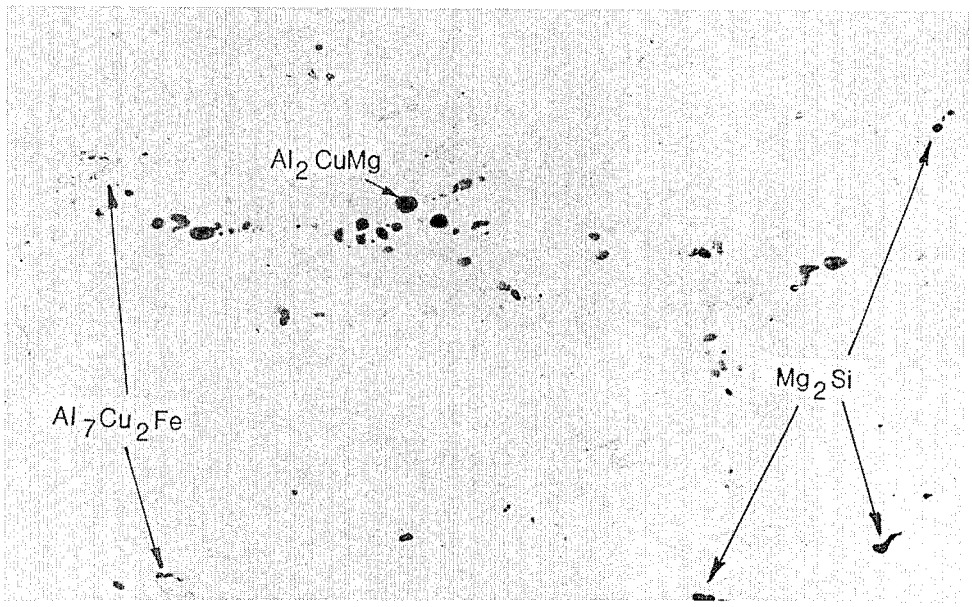
FIG. 1 is a photomicrograph (500x) of an aluminum base alloy plate product at the T/4 location showing Mg-Si and Al-Cu-Mg intermetallic constituent.

An aluminum base alloy product in accordance with the invention can consist essentially of 0 to 3.0 wt.% Cu, 0 to 1.5 wt.% Mn, 0.1 to 4.0 wt.% Mg, 0.8 to 8.5 wt.% Zn, at least 0.005 wt.% Sr, max. 1.0 wt.% Si, max. 0.8 wt.% Fe and max. 0.45 wt.% Cr, 0 to 0.2 wt.% Zr, the remainder aluminum and incidental elements and impurities. When the application for such product is in aircraft or other vehicles where strength and weight are the significant factors, an aluminum base alloy comprising 0.30 to 2.6 wt.% Cu, preferably 1.0 to 2.6 wt.% Cu, 0.8 to 3.7 wt.% Mg, preferably 1.0 to 3.1 wt.% Mg, 1.3 to 8.2 wt.% Zn, preferably 4.0 to 8.2 wt.% Zn and 0.005 to 0.5 wt.% Sr with other alloying elements and impurities not exceeding 1.0 wt.%. It will be noted that in this class of aluminum base alloys, elements such as Cr, Zr and Ti are intentionally added and normally the total of such addition do not exceed 0.5 wt.%. Other elements such as Si and Fe are normally present as impurities and the total of such impurities should not exceed 0.5 wt.%.

FIG. 1 is a photomicrograph at the T/4 location ($\frac{1}{4}$ of the thickness) of an aluminum base alloy plate, the alloy being of the type which finds extensive use in aircraft bulkheads, particularly when the plate is relatively thick, and aircraft wings when the plate is relatively thin. The alloy contains 2.26 wt.% Cu 2.20 wt.% Mg, 6.22 wt.% Zn, 0.07 wt.% Si, 0.11 wt.% Fe, 0.04 wt.% Mn and 0.11 wt.% Zr, the remainder aluminum and incidental impurities. From an inspection of the micrograph, it will be seen that the alloy has significant clusters of soluble intermetallic constituent such as Al-Cu-Mg constituents and Mg-Si, the Al-Cu-Mg normally present as $Al_2CuMg$ and referred to as S phase. Also shown in the micrograph are groups of insoluble intermetallic constituents such as Al-Cu-Fe particles normally present as $Al_7Cu_2Fe$. As referred to earlier, the groups or clusters of large, soluble $Al_2CuMg$ constituent is undesirable because of the extended time periods at controlled temperatures required to put such constituent into solid solution and the difficulty in getting such constituent into solution. That is, the groups or clusters of $Al_2CuMg$ often represent a condition which because of the number and size of these constituents in the alloy, often are difficult to put into solution. The insoluble constituents are undesirable because they remain essentially stable as found in the cast structure and as such interfere with properties of the alloy product since they normally cannot be easily modified.

Figure 2:
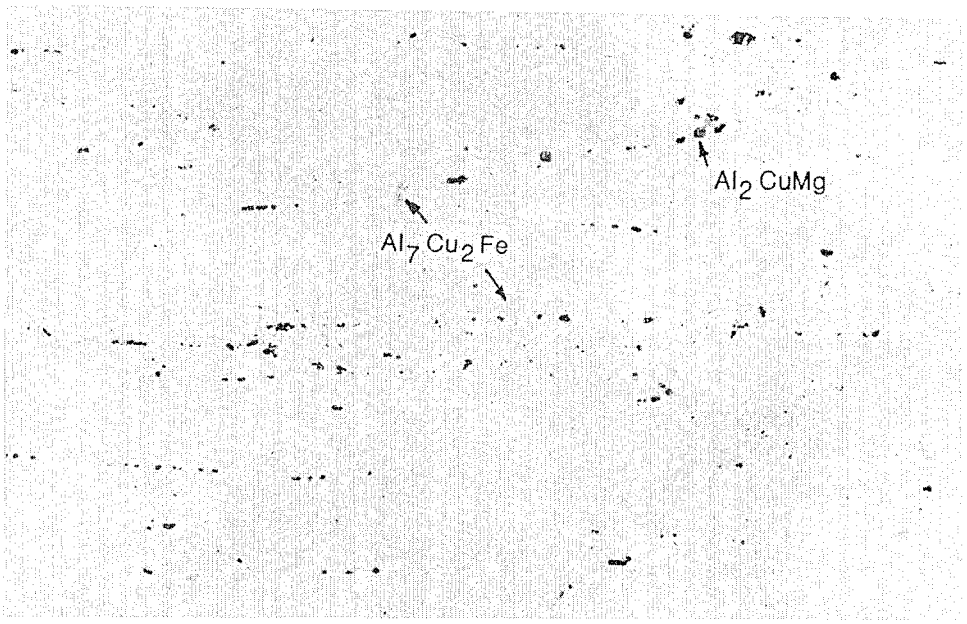
FIG. 2 is a photomicrograph (500x) of the aluminum base alloy plate product of FIG. 1 at the T/4 location in accordance with the invention showing Mg-Si and Al-Cu-Mg intermetallic constituent in a refined condition.

FIG. 2 is a photomicrograph at T/4 plane of an aluminum base alloy plate in accordance with the invention. The alloy of FIG. 2 contains 2.28 wt.% Cu, 2.25 wt.% Mg, 6.30 wt.% Zn, 0.14 wt.% Si, 0.04 wt.% Sr, 0.12 wt.% Fe, 0.04 wt.% Mn and 0.12 wt.% Zr, the remainder aluminum and incidental impurities. From an inspection of FIG. 2 it will be seen that the Al-Cu-Mg intermetallic constituent has been considerably refined. Accordingly, the long soak time necessary to put the Al-Cu-Mg constituent into solid solution is no longer necessary. That is, because Al-Cu-Mg constituent is present in much smaller particles, it dissolves much more readily, greatly shortening the soak times. In addition to refining the soluble constituent, the alloy of the invention has the advantage of having refined insoluble intermetallic constituent. From an inspection of FIG. 2, it will be noted that Al-Cu-Fe and Mg-Si constituents have been refined considerably. As noted earlier, it is very important to have these constituents cast in fine particle form since they are not readily refined in later operations. These fine particles, particularly the soluble particles, because they are easily dissolved, are important for the reasons noted above and for the additional reason that they improve the toughness of this general class of alloys and particularly those used in aircrafts where toughness or resistance to fracture are very important features.

Figure 3:
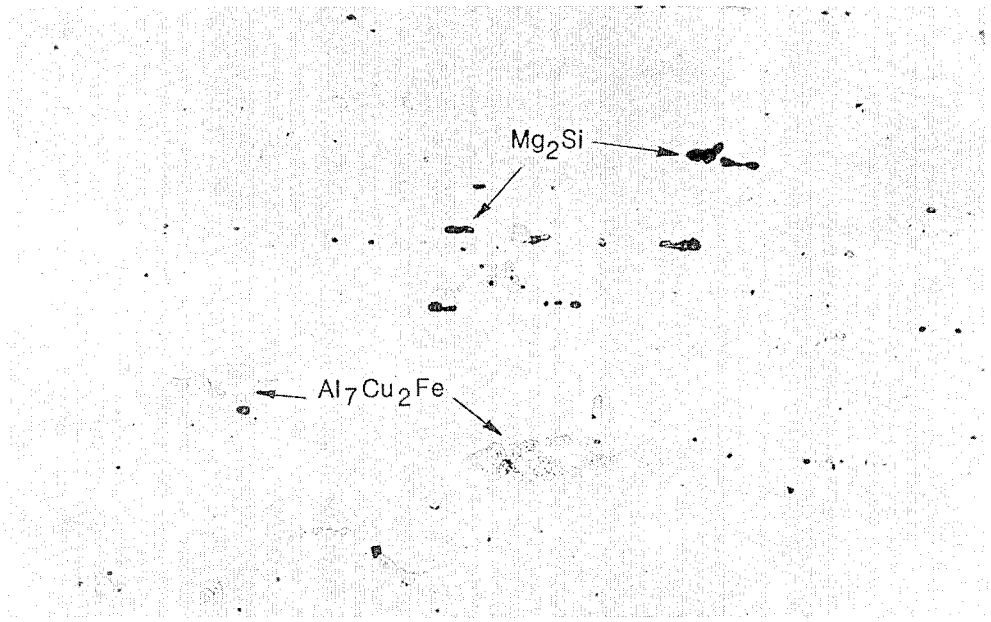
FIG. 3 is a photomicrograph (500x) of the aluminum base alloy plate product of FIG. 1 at the T/2 location in accordance with the invention showing Mg-Si and Al-Cu-Fe intermetallic constituent.
Figure 4:
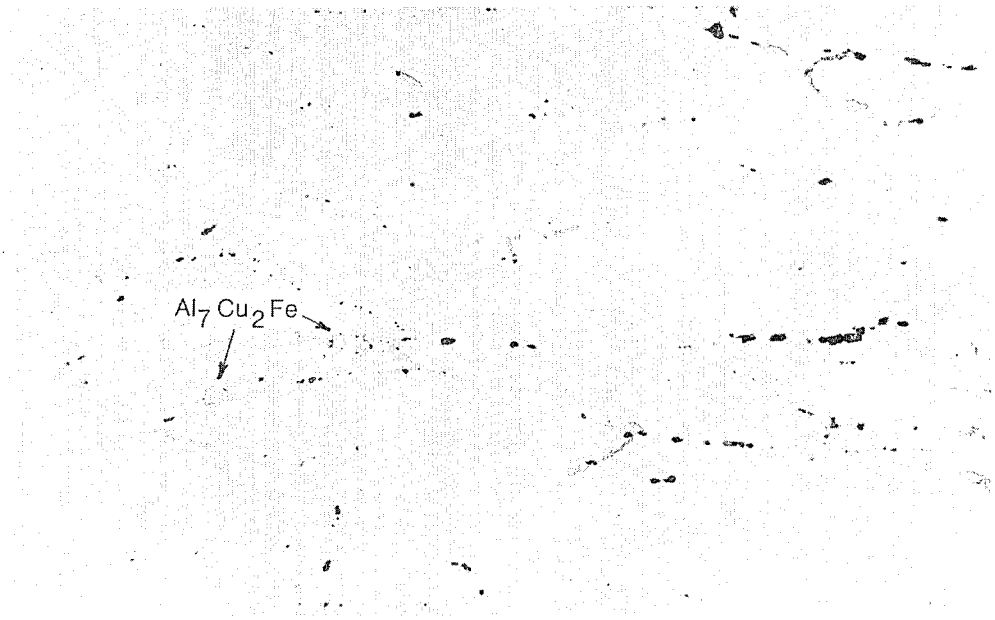
FIG. 4 is a photomicrograph (500x) of the aluminum base alloy plate product of FIG. 1 at the T/2 location in accordance with the invention showing Al-Cu-Fe intermetallic constituent in a refined condition.

FIG. 3 is a photomicrograph of the aluminum base alloy plate of FIG. 1 at the T/2 location ($\frac{1}{2}$ way through the plate). This micrograph highlights the Al-Cu-Fe and Mg-Si constituents. FIG. 4 is a photomicrograph of the aluminum base alloy plate of FIG. 2 at the T/2 location. It will be noted that both the soluble and insoluble constituents in the alloy of the invention are present in a significantly refined condition when compared to the alloy shown in FIG. 3. That is, FIG. 3 shows large agglomerates of the Al-Cu-Fe and Mg-Si constituent. Thus, from these micrographs, it can be seen that both soluble and insoluble constituents are significantly refined when treated in accordance with the invention.

Figure 5:
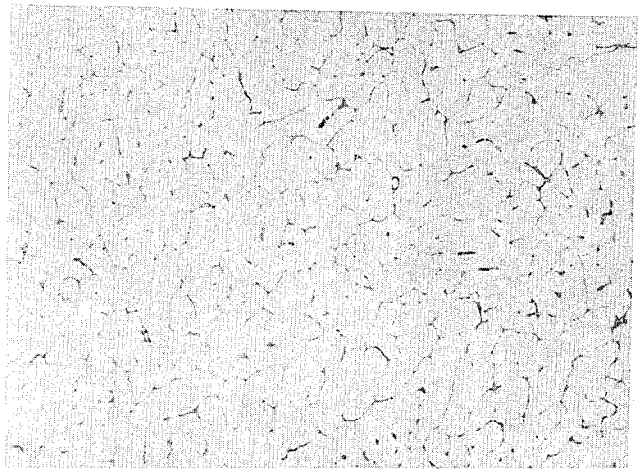
FIG. 5 is a photomicrograph (500x) of the aluminum base alloy product of FIG. 1 showing the cell size.
Figure 6:
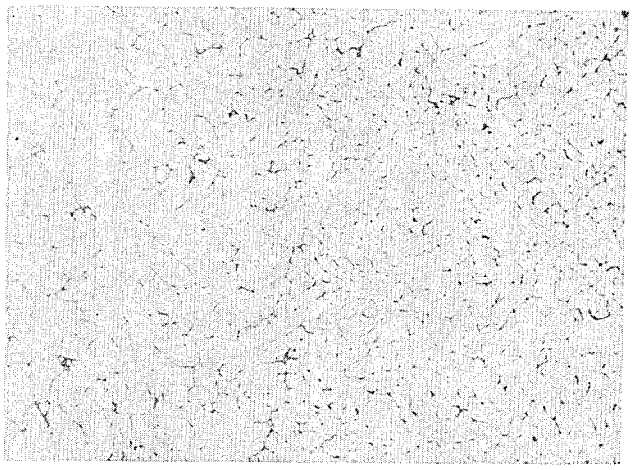
FIG. 6 is a photomicrograph (500x) of the aluminum base alloy product in FIG. 3 treated in accordance with the subject invention and showing refined or smaller cell size.

As well as refining constituents, aluminum alloys of the present invention exhibit significantly refined ingot cell structure. For example, FIG. 5 depicts a photomicrograph of ingot used for the aluminum base alloy plate of FIG. 1 at the T/2 location ($\frac{1}{2}$ way through the ingot). In this micrograph, the average cell size is about 0.0014 inch Referring to FIG. 6, there is shown a photomicrograph of the ingot used for the aluminum base alloy plate of FIG. 2 at the T/2 location. As will be observed in FIG. 6, the cell has been significantly refined, and the average cell size is about 0.0008 inch. The refined cell structure is important in that it represents that intermetallic materials are more uniformly dispersed throughout the alloy.

In one class of aluminum alloys of the invention, copper, magnesium and zinc are the main solute elements and are added mainly for purposes of providing increased strength.

With respect to manganese, it is used mainly as a dispersoid forming element. That is, manganese is an element which is precipitated in small particle form by thermal treatments and has, as one of its benefits, a strengthening effect. Manganese can form dispersoid consisting of Al-Mn, Al-Fe-Mn and Al-Fe-Mn-Si. Chromium can have the advantage of increasing corrosion resistance, particularly stress corrosion. Also, chromium can combine with manganese to provide more dispersoid which, as noted earlier, can increase strength. Preferably, chromium should not exceed 0.25 wt.% for most of the applications for which alloys of the invention may be used.

Solid solubility of iron in aluminum is very low and is on the order of about 0.04 to 0.05 wt.% in ingot. Thus, normally a large part of the iron present is usually found in aluminum alloys as insoluble constituent in combination with other elements such as manganese and silicon, for example. Typical of such combinations are Al-Fe-Mn, Al-Fe-Mn-Si and Al-Fe-Cu. It will be appreciated that the elements in these combinations can be present in various stoichiometric amounts. For example, Al-Fe-Si can be present as $Al_{12}Fe_3Si$ and $Al_9Fe_2Si_2$ which are considered to be the most commonly occurring phases. Also, Al-Fe-Mn can be present as $Al_6(Fe_xMn_{x-1})$, where x is a number greater than 0 and less than 1. With respect to Al-Fe-Cu, this combination can be present as $Al_7Cu_2Fe$. It should be noted that these constituents are considered to be the most common intermetallic phases found in these types of alloys. However, it should be understood that other elements, such as Ti and Cr and the like can appear in or enter into the intermetallic phases referred to in minor amounts by substituting usually for part of the Fe or Mn. Such intermetallic phases are also contemplated within the purview of the invention. As noted earlier, these insoluble constituents tend to agglomerate and form relatively large particles, such as Al-Cu-Fe constituents, as is best seen in FIG. 1. Further, it must be understood that iron is normally present in most aluminum alloys, mainly from an economic standpoint. That is, processing aluminum to remove iron for most applications is normally not economically feasible. Thus, many attempts have been made to work with iron in the alloy by taking advantage of its benefits and neutralizing its disadvantages often with only limited success. Thus, preferably, for purposes of the present invention, iron is maintained at 0.8 wt.% or lower, and typically less than 0.5 wt.%, with amounts of 0.4 wt.% or less being quite suitable.

Titanium also aids in grain refining and may be present in not more than 0.3 wt.%.

For purposes of the present invention, it is believed that the amount of silicon also should be minimized since, at relatively low levels it can combine with magnesium, resulting in significant strength reductions. Thus, preferably, silicon should be maintained at less than 0.5 wt.% and typically less than 0.35 wt.%.

Strontium is also an important component in the alloys of the present invention. Strontium must not be less than 0.005 wt.% and preferably is maintained in the range of 0.005 wt.% to 0.5 wt.% with additional amounts not presently believed to affect the performance of the products adversely, except that increased amounts may not be desirable from an economic standpoint. For most applications for which alloys of the present invention may be used, strontium is preferably present in the range of 0.01 wt.% to 0.25 wt.%, with typical amounts being in the range of 0.01 wt.% to 0.1 wt.%.

The addition of at least one of strontium, antimony and calcium to the composition has the effect of refining or modifying intermetallic phases, including both insoluble and soluble constituents of the type containing Al-Cu-Fe, Al-Cu-Mg and Mg-Si, as noted earlier. Because of the complex nature of these phases, it is not clearly known how this effect comes about. That is, because of the multiplicity of alloying elements and the interaction with each other, it is indeed quite surprising that a significant refinement of these constituents is obtained. However, the benefit of adding strontium can be clearly seen by comparing the micrographs of plate product shown in FIGS. 1 through 6.

Zirconium is added for purposes of inhibiting recrystallization tendencies of the final product during thermal treatments. That is, the use of zirconium in the alloy assures an essentially unrecrystallized grain structure even after the product is annealed or solution heat treated. It is this unrecrystallized grain structure in selected composition which contributes significantly to resistance to stress corrosion cracking and which adds to fracture toughness.

Ingots having the compositions indicated for the plate of FIGS. 1 and 2 and from which these plate products were rolled were cast by the direct chill method. The ingots were then scalped and preheated prior to hot rolling. For purposes of preheat or homogenization, the ingot of FIG. 2 was first subjected to a temperature of 860° F. for 5 hours followed by 8 hours at 890° F. The alloy having the composition referred to for FIG. 1 was given a conventional preheat or homogenization treatment which is much longer than that referred to for FIG. 2. After preheat, the ingots were hot rolled to 4.5 inch thick plate starting at a temperature of about 750° F. Thus, it will be seen that one advantage of the alloy of the invention resides in the short preheat time.

As well as providing the wrought product in compositions having controlled amounts of alloying elements as described above, it is preferred that compositions be prepared and fabricated into products according to specific method steps in order to provide the most desirable characteristics. Thus, the alloys described herein can be provided as an ingot or billet or can be strip cast for fabrication into a suitable wrought product by techniques currently employed in the art. Further, the alloys can be provided in castings, such as die castings and the like. The cast material, such as the ingot, may be preliminarily worked or shaped to provide suitable stock for subsequent working operations. In certain instances, prior to the principal working operation, the alloy stock may be subjected to homogenization treatment and preferably at metal temperatures in the range of 800° F. to 910° F. Best results are normally obtained when the homogenization treatment is provided in two steps, as noted earlier. In the first step, the temperature can range from 700° or 750° to 870° F. for a period in the range of 2 to 20 hours. For the second step, the temperature can be in the range of 870° to 910° F. for a period in the range of 6 to 36 hours. These soak times act to effectively dissolve constituents such as Al-Cu-Mg and Al-Cu. It should be understood that longer soak times may be employed and are not normally detrimental. After an appropriate homogenizing treatment, the metal can be rolled or extruded or otherwise subjected to working operation to produce stock, such as plate sheet, extrusion, forgings or other stock suitable for shaping or machining into the end product.

When the intended use of selected compositions is for aircraft applications, the final reduction can be to plate having thicknesses of 0.25 to 7.0 inches. However, a body of the alloy may be rolled to sheet thickness, e.g. 0.040 to 0.249 inch, depending on the end use. After rolling a body of the alloy to a desired thickness, the rolled product, or other products such as castings and forgings, are subjected to a solution heat treatment to substantially dissolve soluble elements. Typically the solution heat treatment is preferably accomplished at a temperature in the range of 800° to 890° F. for a period in the range of 178 to 4 hours.

After solution heat treatment, the worked or wrought product is quenched, preferably by spray quenching or by immersion in water at a temperature not in excess of 100° F. The quenched product can be artificially aged to fully develop its properties. For selected compositions, the aging treatment may consist of 10 to 180 hours at a temperature of from 200° to 300° F. to produce, for example, sheet in what may be called T6 type temper where it is desired to obtain strength and resistance to tear. Or, where it is desired to achieve resistance to stress corrosion cracking a two step aging process may be employed. Typical of such aging is a first step for 2 to 100 hours at a temperature of 200° to 255° F. and the second step being 2 to 48 hours at 300° to 375° F. Afterwards, if a flat rolled product is involved, it can be stretched to the desired flatness.

When the intended use of an alloy in accordance with the invention is extrusions, as used in coal hopper cars, for example, preferably the alloy consists essentially of 0.20 to 0.7 wt.% Mn, 1.0 to 1.8 wt.% Mg, 0.06 to 0.20 wt.% Cr, 3.6 to 5.0 wt.% Zn, 0.08 to 0.20 wt.% Zr, at least 0.005 wt.% Sr, max. 0.35 wt.% Si, max. 0.40 wt.% Fe and max. 0.1 wt.% Cu, max. 0.1 wt.% Ti, the remainder aluminum and impurities, the impurities preferably not exceeding 0.15 wt.%. When the use of the alloy of the invention is automobile bumpers, the alloy consists mainly of 0.45 to 1.1 wt.% Cu, 0.8 to 1.4 wt.% Mg, 4.0 to 5.2 wt.% Zn, 0.005 to 0.25 wt.% Sr, max. 0.15 wt.% Si, max. 0.30 wt.% Fe, max. 0.05 wt.% Mn, Ga, Va and Ti, the remainder aluminum and impurities, the maximum of each of which is 0.05 wt.% with the total of such impurities not exceeding 0.15 wt.%. It will be understood that having refined constituent in extrusions or sheet used for bumpers is an important feature which permits a brighter anodized finish. If the intended use of the alloy of the invention is backup or reinforcement bars for bumpers, then the alloy should consist essentially of 1.0 to 3.3 wt.% Mg, 3.5 to 9.0 wt.% Zn, at least 0.005 wt.% Sr, max. 0.30 wt.% Si, max. 0.40 wt.% Fe, 0 to 0.9 wt.% Cu, max. 0.40 wt.% Mn, max. 0.25 wt.% Cr, max 0.10 wt.% Ti, the remainder aluminum and impurities, each impurity not exceeding 0.05 wt.% and totally not exceeding 0.20 wt.%.

With respect to aircraft applications, such as wing skins where high fracture toughness is important in sheet and plate, the alloy normally consists of 1.2 to 1.9 wt.% Cu, 1.9 to 2.6 wt.% Mg, 0.18 to 0.25 wt.% Cr, 5.2 to 6.2 wt.% Zn, 0.005 to 0.35 wt.% Sr, max. 0.06 wt.% Mn, max. 0.10 wt.% Si and max. 0.12 wt.% Fe, max. 0.06 wt.% Ti, the remainder aluminum and impurities, the total of impurities not exceeding 0.15 wt.%. Typically, the sheet thickness for wing skin applications is in the range of 0.04 to 0.249 inch and plate normally does not exceed 1.5 inch. When the application is structural components, such as fuselage bulkheads, wing box ribs and the like for aircrafts, the preferred alloy can contain 1.2 to 2.6 wt.% Cu, 2.0 to 2.9 wt.% Mg, 5.1 to 6.9 wt.% Zn, 0.08 to 0.15 wt.% Zr (Zr being optional in some applications), 0.005 to 0.35 wt.% Sr, max. 0.40 wt.% Si, max. 0.50 wt.% Fe, max 0.30 wt.% Mn, 0 to 0.25 wt.% (Cr being optional depending on the application), max. 0.20 wt.% Ti, the remainder aluminum and impurities, the total of which should not exceed 0.20 wt.%. It should be noted that the alloy may be used as plate, extrusion and forgings in aircraft as well as for wing skins.

While the invention has been described in terms of preferred embodiments, the claims appended hereto are intended to encompass other embodiments which fall within the spirit of the invention.

What is claimed is:

1. An improved aluminum base alloy product consisting essentially of 1.0 to 2.6 wt.% Cu, max. 0.3 Mn, 1.0 to 3.1 wt.% Mg. 4.0 to 8.2 wt.% Zn, 0.005 to 0.5 wt. % Sr, max. 0.18 Zr, max. 0.25 Cr, max. 0.4 Fe, max. 0.5 Si, the remainder aluminum and incidental elements and impurities.

2. A wrought aluminum base alloy product consisting essentially of 1.0 to 2.6 wt.% Cu, 0 to 1.5 wt.% Mn, 0.1 to 4.0 wt.% Mg, 4.0 to 8.2 wt. % Zn, 0.005 to 0.5 wt.% Sr, max. 1.0 wt.% Si, max. 0.8 wt.% Fe and max 0.45 wt.% Cr, 0 to 0.2 wt.% Zr, the remainder aluminum and incidental elements and impurities.

3. A wrought aluminum base alloy product consisting essentially of 1.0 to 2.6 wt. % Cu, max. 0.3 Mn, 1.0 to 3.1 wt.% Mg. 4.0 to 8.2 Zn, 0.005 to 0.5 wt.% Sr, max. 0.18 Zr, max. 0.25 Cr, max. 0.4 Fe, max. 0.5 Si, the remainder aluminum and incidental elements and impurities.

4. An aluminum extrusion product consisting essentially of 0.20 to 0.7 wt.% Mn, 1.0 to 1.8 wt.% Mg, 0.06 to 0.20 wt.% Cr, 3.6 to 5.0 wt. % Zn, 0.08 to 0.20 wt.% Zr, 0.005 to 0.5 wt.% Sr, max. 0.35 wt.% Si, max. 0.40 wt.% Fe and max. 0.1 wt.% Cu, max. 0.1 wt.% Ti, the remainder aluminum and impurities.

5. An aluminum base alloy for automobile bumpers, the alloy consisting of 0.45 to 1.1 wt.% Cu, 0.8 to 1.4 wt.% Mg, 4.0 to 5.2 wt.% Zn, 0.005 to 0.25 wt.% Sr, max. 0.15 wt.% Si, max. 0.30 wt.% Fe, max. 0.05 wt.% Mn, Ga, Va and Ti, the remainder aluminum and impurities.

6. Improved sheet or plate suitable for aircraft applications consisting essentially of 1.2 to 1.9 wt.% Cu, 1.9 to 2.6 wt.% Mg, 0.18 to 0.25 wt.% Cr, 5.2 to 6.2 wt.% Zn, 0.005 to 0.35 wt.% Sr, max. 0.06 wt.% Mn, max. 0.10 wt.% Si and max. 0.12 wt.% Fe, max. 0.06 wt.% Ti, the remainder aluminum and impurities, the total of impurities not exceeding 0.15 wt.%.

7. A process for producing an improved aluminum base alloy wrought product having refined interetallic constituent, the process comprising the steps of:

(a) providing a body of aluminum base alloy consisting essentially of 1.0 to 2.6 wt.% Cu, 0 to 1.5 wt.% Mn, 0.1 to 4.0 wt.% Mg. 4.0 to 8.5 wt. % Zn, 0.005 to 0.5 wt.% Sr, max. 1.0 wt.% Si, max. 0.8 wt.% Fe and max. 0.45 wt.% Cr, 0 to 0.2 wt.% Zr, the remainder aluminum and incidental elements and impurities, the body characterized by having refined intermetallic constituent therein;

(b) homogenizing said body to dissolve soluble intermetallic constituents; and (c) working said body to provide said wrought product.

8. The method in accordance with claim 7 including an improved aluminum base alloy product in accordance with claim 1 wherein Mg is in the range of 0.8 to 3.7 wt%.

9. The method in accordance with claim 7 including providing Mg is in the range of 1.0 to 3.1 wt.%.

10. The method in accordance with claim 7 including providing Mn has a maximum of 0.3 wt.%.

11. The method in accordance with claim 7 including providing Zr has a maximum of 0.18 wt.%.

12. The method in accordance with claim 7 including providing Cr has a maximum of 0.25 wt.%.

13. The method in accordance with claim 7 including providing Fe has a maximum of 0.4 wt.%.

14. The process in accordance with claim 7 including homogenizing in a two step treatment wherein the second step is capable of being carried out in a time period as short as 8 hours.

15. A process for producing an improved alumninum base alloy wrought product having refined intermetallic constituent, the process comprising the steps of:

(a) providing a body of aluminum base alloy consisting essentially of 1.0 to 2.6 wt.% Cu, max. 0.3 Mn, 1.0 to 3.1 wt. % Mg. 4.0 to 8.2 wt.% Zn, 0.005 to 0.5 wt.% Sr, max. 0.18 wt.% Zr, max. 0.25 wt.% Cr, max. 0.4 wt.% Fe, max. 0.5 wt.% Si, the remainder aluminum and incidental elements and impurities, the body characterized by having refined intermetallic constituent therein;

(b) homogenizing said body to dissolve soluble intermetallic constituent, said constituent being capable of being dissolved using time periods of less than 15 hours; and (c) working said body to provide said wrought product.

16. The process in accordance with claim 7 wherein said working includes rolling said body to a sheet or plate product.

17. The process in accordance with claim 7 including homogenizing at a temperature in the range of 700° to 910° F.

18. The process in accordance with claim 7 wherein said working includes extruding said product.

19. A process for producing an improved aluminum base alloy wrought product having refined intermetallic constituent, the process comprising the steps of:

(a) providing a body of aluminum base alloy consisting essentially of 0.20 to 0.7 wt.% Mn, 1.0 to 1.8 wt.% Mg, 0.06 to 0.20 wt.% Cr, 3.6 to 5.0 wt.% Zn, 0.08 to 0.20 wt.% Zr, 0.005 to 0.5 wt.% Sr, max. 0.35 wt.% Si, max. 0.40 wt.% Fe and max. 0.1 wt.% Cu, max. 0.1 wt.% Ti, the remainder aluminum and impurities, the body characterized by having refined intermetallic constituent therein;

(b) homogenizing said body to dissolve soluble intermetallic constituent, said constituent being capable of being dissolved using time periods of less than 15 hours; and (c) working said body to provide said wrought product.

20. A process for producing an improved aluminum base alloy wrought product having refined intermetallic constituent, the process comprising the steps of:

(a) providing a body of aluminum base alloy consisting essentially of 0.45 to 1.1 wt.% Cu, 0.8 to 1.4 wt.% Mg, 4.0 to 5.2 wt.% Zn, 0.005 to 0.25 wt.% Sr, max. 0.15 wt.% Si, max. 0.30 wt.% Fe, max. 0.05 wt.% Mn, Ga, Va and Ti, the remainder aluminum and impurities, the body characterized by having refined intermetallic constituent therein;

(b) homogenizing said body to dissolve a portion of said intermetallic constituent, said constituent being capable of being dissolved using time periods of less than 15 hours; and (c) working said body to provide said wrought product.

21. A process for producing an improved aluminum base alloy wrough product having refined intermetallic constituent, the process comprising the steps of:

(a) providing a body of aluminum base alloy consisting essentially of 1.0 to 3.3 wt.% Mg. 4.0 to 9.0 wt.% Zn, 0.005 to 0.5 wt.% Sr, max. 0.30 wt.% Si, max. 0.40 wt.% Fe, 0 to 0.9 wt.% Cu, max. 0.40 wt.% Mn, max. 0.25 wt.% Cr, max. 0.10 wt.% Ti, the remainder aluminum and impurities, each impurity not exceeding 0.05 wt.% and totally not exceeding 0.20 wt.%, the body characterized by having refined intermetallic constituent therein;

(b) homogenizing said body to dissolve a portion of said intermetallic constituent, said constituent being capable of being dissolved using time periods of less than 15 hours; and (c) working said body to provide said wrought product.

22. A process for producing an improved aluminum base alloy wrought product having refined intermetallic constituent, the process comprising the steps of:

(a) providing a body of aluminum base alloy consisting essentially of 1.2 to 1.9 wt.% Cu, 1.9 to 2.6 wt.% Mg, 0.18 to 0.25 wt.% Cr, 5.2 to 6.2 wt.% Zn, 0.005 to 0.35 wt.% Sr, max. 0.06 wt.% Mn, max. 0.10 wt.% Si and max. 0.12 wt.% Fe, max. 0.06 wt.% Ti, the remainder aluminum and impurities, the total of impurities not exceeding 0.15 wt.%, the body characterized by having refined intermetallic constituent therein;

(b) homogenizing said body to dissolve a portion of said intermetallic constituent, said constituent being capable of being dissolved using time periods of less 15 hours; and (c) working said body to provide said wrought product.

23. The process in accordance with claim 19 wherein said working includes extruding said body to provide said product.

24. The process in accordance with claim 22 wherein said working includes rolling said body to provide a sheet or plate product.

25. A wrought aluminum alloy bumper for automotive use, the bumper fabricated from an aluminum base alloy consisting essentially of 0.45 to 1.1 wt.% Cu, 0.8 to 1.4 wt.% Mg, 4.0 to 5.2 wt.% Zn, 0.005 to 0.25 wt.% Sr, max. 0.15 wt.% Si, max. 0.30 wt.% Fe, max. 0.05 wt.% Mn, Ga, Va and Ti, the remainder aluminum and impurities.

26. A wrought aluminum alloy reinforcement bar for automobile bumpers, the reinforcement bar fabricated from an aluminum base alloy consisting essentially of 1.0 to 3.3 wt.% Mg, 3.5 to 9.0 wt.% Zn, 0.005to 0.5 wt.% Sr, max. 0.30 wt.% Si, max. 0.40 wt.% Fe, 0 to 0.9 wt.% Cu, max. 0.40 wt.% Mn, max. 0.25 wt.% Cr, max 0.10 wt.% Ti, the remainder aluminum and impurities, each impurity not exceeding 0.05 wt.% and totally not exceeding 0.20 wt.%.

* * * * *